US006243963B1

(12) United States Patent
Jones et al.

(10) Patent No.: US 6,243,963 B1
(45) Date of Patent: Jun. 12, 2001

(54) DIVIDING RULE

(75) Inventors: Steve K. Jones, Nepean; Terry Ross Saunders, North Gower, both of (CA)

(73) Assignee: Lee Valey Tools, Ltd., Ottawa (CA)

( * ) Notice: Subject to any disclaimer, the term of this patent is extended or adjusted under 35 U.S.C. 154(b) by 0 days.

(21) Appl. No.: 09/315,256

(22) Filed: May 20, 1999

Related U.S. Application Data

(60) Provisional application No. 60/086,312, filed on May 21, 1998.

(51) Int. Cl.[7] ..... B43L 9/08

(52) U.S. Cl. ..... 33/663; 33/494; 33/562

(58) Field of Search ..... 33/494, 41.1, 41.4, 33/41.6, 42, 44, 520, 613, 644, 663, 664, 665, 679.1, 483, 484, 485, 486, 487, 490, 492, 430, 436, 443, 446, 562, 566

(56) References Cited

U.S. PATENT DOCUMENTS

| | | | | |
|---|---|---|---|---|
| 663,053 | * | 12/1900 | Wangler | 33/663 |
| 827,792 | * | 8/1906 | Edmondson | 33/663 |
| 1,810,392 | * | 6/1931 | Clark | 33/483 |
| 2,612,690 | * | 10/1952 | Cotton | 33/485 |
| 2,677,186 | * | 5/1954 | Sorensen | 33/520 |
| 2,764,818 | * | 10/1956 | Gard | 33/520 |
| 3,271,869 | * | 9/1966 | Ratner | 33/41.4 |
| 3,885,316 | * | 5/1975 | Casten | 33/663 |
| 4,731,931 | * | 3/1988 | Goodman et al. | 33/520 |
| 5,615,485 | * | 4/1997 | Stoneberg | 33/562 |

OTHER PUBLICATIONS

Lee Valley & Veritas 1997/1998 catalog, 20th Anniversary Issue, p. 9 item A; p. 11 items G, H, & J; and p. 12, item E.

* cited by examiner

*Primary Examiner*—Christopher W. Fulton
(74) *Attorney, Agent, or Firm*—John S. Pratt; Kristin L. Johnson; Kilpatrick Stockton LLP

(57) ABSTRACT

A dividing rule that allows the user to divide a workpiece into equal divisions with heightened accuracy and ease. The dividing rule is a plate with pins attached at the corners of the plate which help position the plate on the workpiece. Holes marked with appropriate divisions are located on the plate so that the user, to partition the workpiece into equal divisions, simply marks the workpiece using the holes that coincide with the desired number of divisions.

15 Claims, 2 Drawing Sheets

DIVIDING RULE

REFERENCE TO RELATED APPLICATION

This application is based on and hereby refers to U.S. Provisional Patent Application Serial No. 60/086,312, filed May 21, 1998, having the title "Dividing Ruler."

FIELD OF THE INVENTION

This invention relates to a dividing rule for partitioning a workpiece into a number of equal parts.

BACKGROUND OF THE INVENTION

Dividing a workpiece into a number of equal parts is usually done by placing a ruler askew on the workpiece and eyeballing pencil locations against the inch marks. Measuring devices equipped with holes for inserting a pencil or other marking tool to mark the correct position on the workpiece have also been used. For instance, diamond shaped as well as circular holes have been used in framing squares. More recently, holes have been used in the Veritas® Sliding Square and in Incra® brand perforated measuring tools. The difficulty, however, in correctly positioning the ruler or other measuring instrument and holding it in place leads to marking errors that jeopardize the accuracy of the division.

SUMMARY OF THE INVENTION

This invention is a dividing rule that allows the user to divide a workpiece into equal divisions with heightened accuracy and ease. The dividing rule is a plate with pivoting pins attached at its corners. Position indicia, such as holes, are spaced along the plate, dividing the edges of the plate into halves, thirds, quarters, fifths, sixths, sevenths, eighths, ninths and tenths (other numbers of divisions are also possible). Each hole is numbered with its coinciding division for easy identification.

The pins have flat faces so that, when using the rule, the flat faces of opposing pins are positioned against opposing edges of the workpiece. This helps hold the rule firmly in position to ensure that the accuracy of the division process is not compromised. Once the plate is properly positioned, the user simply uses a pencil or other marking device to mark the holes that coincide with the number of desired divisions. Once the holes are marked, the user can use a straight edge of the plate or a square to draw the dividing lines.

DETAILED DESCRIPTION OF THE DRAWINGS

Figure 1:
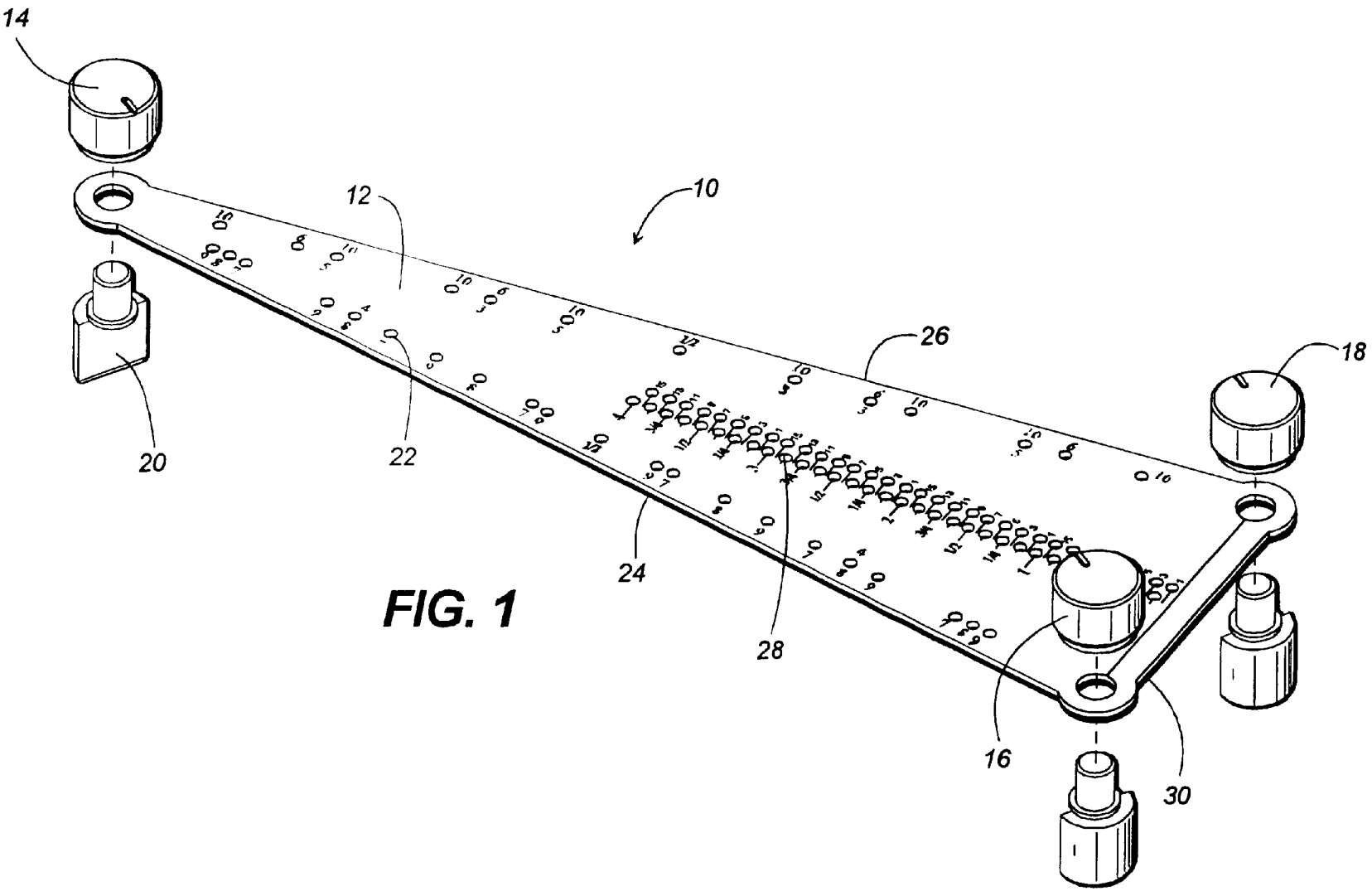
FIG. 1 is an exploded perspective view of the dividing rule.
Figure 2:
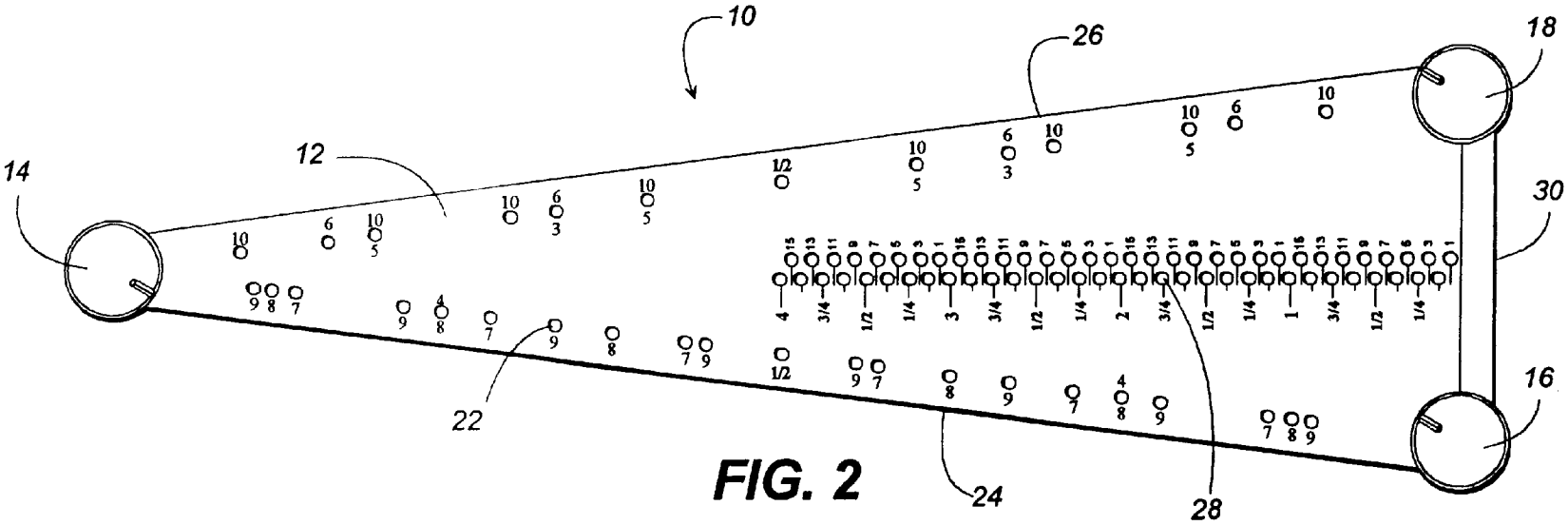
FIG. 2 is a plan view of the dividing rule.
Figure 3:
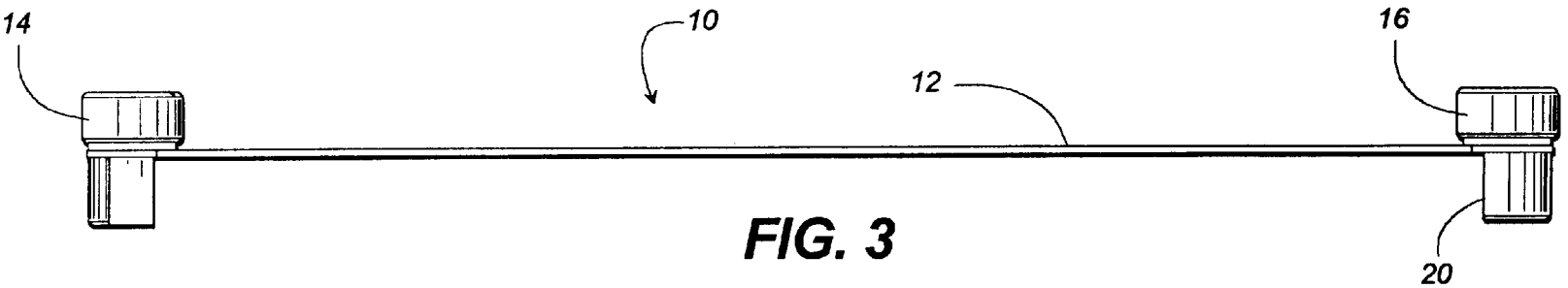
FIG. 3 is a lateral view of the dividing rule.

FIGS. 1–3 illustrate a dividing rule 10 in accordance with the present invention. The rule 10 consists of a plate 12 with pins 14, 16, 18 attached at its corners that pivot relative to the plate 12. In one embodiment, depicted in FIG. 1, the plate 12, generally in the form of an isosceles triangle, serves as a body in which a first pin 14, second pin 16, and third pin 18, each with flat faces 20, are located at each corner of the plate 12.

The plate 12 contains sets of position indicia, preferably holes 22, each of which set is spaced at equal intervals along one of the two virtual lines 24, 26 that connects the center of the first pin 14 with the centers of the second pin 16 and third pin 18. Each set of holes 22 is labeled with the number of intervals between the set of marks. For instance, each of the holes 22 necessary for dividing the workpiece into ten divisions has a "10" beside it.

The pins 14, 16, 18 are formed such that they each have a flat face 20, the plane of which lies on the central longitudinal axis of the pins 14, 16, 18 so that the flat faces 20 run through the center of each pin 14, 16, 18. This ensures that when the divider rule is used, the line that is divided is the true center-to-center distance, and not the tangent-to-tangent distance.

The rule is positioned on a workpiece to be marked with equal-width divisions by positioning the plate 12 diagonally across the workpiece so that the flat faces 20 of pin 14 and either pin 16 or pin 18 (depending on which virtual line 24, 26 has the desired number of divisions along it) lie against opposing edges of the workpiece. A pencil or other marking device is then inserted into each hole 22 corresponding to the number of divisions desired. For example, if the user wants to divide the workpiece into 10 equal parts, the holes 22 with a corresponding "10" next to them are marked. The user can then use these marks as reference points for sectioning the workpiece.

While the plate 12 of the present invention may be made from a variety of materials possessing suitable physical properties including structural integrity and rigidity, a plate 12 made from metal is particularly effective. More particularly, the plate 12 is preferably an elongated triangle of etched stainless steel with the holes 22 located along the lines connecting the three pivoting pins 14, 16, 18. Moreover, the pivoting pins 14, 16, 18 may be machined brass.

A further feature of the invention is distance indicia, preferably holes 28, spaced at intervals normal to the line 30 connecting the second pin 16 and third pin 18. This allows the invention to function as a marking gauge by positioning a pencil point in one of the holes 28 and sliding the invention along a workpiece with the pair of pins 16, 18 against its edge, making a line parallel to the edge and of whatever distance from the edge of the workpiece the user desires. Because the pins 16, 18 pivot, the device can be used as a marking gauge around curved edges also.

While this detailed discussion of the plate presents it in the form of a triangle, which permits holes 22 for marking various numbers of divisions to be located along two separate lines 24, 26, the dividing rule 10 of the present invention need not necessarily be triangular in shape. Two pins could be used in a rectangular rule, for instance, with a single line of holes.

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A dividing rule, comprising a plate having position indicia and at least two pins that allow a user to position the plate so that the center of the pins are positioned at opposed edges of a workpiece, wherein at least one pin has a rotational axis and a flat face lying on a plane containing the rotational axis of the pin and wherein the position indicia indicate at least one set of equally spaced intervals between the centers of the pins.

2. The dividing rule of claim 1, wherein the pins are brass.

3. The dividing rule of claim 1, wherein the plate is metal.

4. The dividing rule of claim 1, wherein the position indicia are holes in the plate.

5. The dividing rule of claim 1, wherein the plate is generally triangular having a first corner, a second corner, and a third corner.

6. The dividing rule of claim 5, wherein the at least two pins comprise a first pin rotatably mounted at the first corner, a second pin rotatably mounted at the second corner, and a third pin rotatably mounted at the third corner.

7. The dividing rule of claim 6, wherein at least some of the position indicia are located between the first pin and the second pin.

8. The dividing rule of claim 6, wherein at least some of the position indicia are located between the first pin and the third pin.

9. The dividing rule of claim 6, wherein the plate further comprises a series of position indicia spaced at intervals normal to a line that connects the second pin and the third pin.

10. A dividing rule, comprising a plate having position indicia and at least two pins rotatably mounted on the plate that allow a user to position the plate so that the centers of the pins can lie against opposed edges of a workpiece, wherein the position indicia indicate at least one set of equally spaced intervals between the centers of the pins.

11. A dividing rule, comprising:

a. a metal plate having position indicia comprising holes located along an edge of the plate, the holes indicating at least one set of equally spaced intervals; and b. a first pin and a second pin rotatably mounted on the plate, each pin having a rotational axis and a flat face lying on a plane containing the rotational axis of the pin that allows the user to position the plate so that the rotational axes of at least two pins are positioned at opposed edges of a workpiece.

12. A dividing rule, comprising:

a. a metal, generally triangular plate having:

(i) a first corner, a second corner, and a third corner;

(ii) a first edge between the first corner and the second corner, a second edge between the first corner and the third corner, and a third edge between the second corner and the third corner; and (iii) holes in the plate wherein some of the holes are located along the first edge and the second edge; and b. a first pin rotatably mounted at the first corner, a second pin rotatably mounted at the second corner, and a third pin rotatably mounted at the third corner, each pin having a rotational axis and a flat face lying on a plane containing the rotational axis of the pin that allows the user to position the plate so that the rotational axes of at least two pins are positioned at opposed edges of a workpiece.

13. The dividing rule of claim 12, wherein at least some of the holes are spaced at intervals normal to the third edge of the plate.

14. A method of dividing a workpiece having two opposed edges into parts comprising:

a. positioning a plate having position indicia and pins rotatably mounted on the plate diagonally across the workpiece so that the centers of the pins lie against the opposed edges of the workpiece, wherein the position indicia indicate at least one set of equally spaced intervals between the centers of the pins; and b. marking the workpiece at intervals as indicated by the position indicia.

15. A method of marking a workpiece a desired distance from an edge of the workpiece comprising:

a. positioning a plate having distance indicia and two pins rotatably mounted on the plate so that the centers of the pins lie against the edge of the workpiece, wherein the position indicia indicate at least one set of equally spaced intervals between the centers of the pins; and b. marking the workpiece at the desired distance from the edge as indicated by reference to an appropriate distance indicia.

* * * * *

UNITED STATES PATENT AND TRADEMARK OFFICE

CERTIFICATE OF CORRECTION

PATENT NO. : 6,243,963 B1
DATED : June 12, 2001
INVENTOR(S) : Steve K. Jones and Terry Ross Saunders It is certified that error appears in the above-identified patent and that said Letters Patent is hereby corrected as shown below:

Title page,
Item [73], please change the Assignee's name to read as follows:

-- Lee Valley Tools, Ltd. --.

Signed and Sealed this

Ninth Day of September, 2003

JAMES E. ROGAN
*Director of the United States Patent and Trademark Office*